US005579910A

United States Patent [19]

Bennett

[11] Patent Number: 5,579,910

[45] Date of Patent: Dec. 3, 1996

[54] DISPENSING PACKAGE

[75] Inventor: Robert Bennett, Easton, Conn.

[73] Assignee: Chesebrough-Pond's USA Co., Division of Conopco, Inc., Greenwich, Conn.

[21] Appl. No.: 366,511

[22] Filed: Dec. 30, 1994

[51] Int. Cl.[6] ..... B65D 83/02

[52] U.S. Cl. ..... 206/362; 206/469; 206/815

[58] Field of Search ..... 206/361, 362, 206/467, 469, 470, 443, 815; 229/240, 242

[56] References Cited

U.S. PATENT DOCUMENTS

| | | |
|---|---|---|
| 1,157,951 | 10/1915 | Monroe . |
| 1,329,012 | 1/1920 | Pick . |
| 1,986,101 | 1/1935 | Brodsky . |
| 2,101,579 | 12/1937 | Hamer . |
| 2,455,685 | 12/1948 | Lehman . |
| 3,261,501 | 7/1966 | Capucio . |
| 3,428,171 | 2/1969 | Blish . |
| 4,630,735 | 12/1986 | Jebens . |
| 4,664,291 | 5/1987 | Gunderson . |
| 4,989,730 | 2/1991 | Lemoine . |
| 5,147,035 | 9/1992 | Hartman . |

FOREIGN PATENT DOCUMENTS

| | | |
|---|---|---|
| 7713-036 | 5/1979 | Netherlands . |

*Primary Examiner*—Jacob K. Ackun
*Attorney, Agent, or Firm*—Gerard J. McGowan, Jr.

[57] ABSTRACT

A package especially useful for dispensing cotton swabs. The package includes a cover comprised of a thin plastic bubble and a base made of paperboard. The cover is adhered to the base along its periphery. An access opening if formed by lines of weakness in both the cover and the base. The opening permits removal of the swabs by the consumer, but prevents escape of the swabs during normal use.

9 Claims, 3 Drawing Sheets

DISPENSING PACKAGE

BACKGROUND OF THE INVENTION

A well known personal care product is the cotton swab, which typically comprises a cylindrical stick having a ball of a fibrous material, such as cotton, at each end. These products have many uses, including application of cosmetics and in medical treatment.

Since many of the uses of the swabs require that the swab be kept clean, it is important that the package in which the swabs are sold and dispensed minimize the risk of contamination, e.g., from dust and dirt. Particularly important is easy dispensing of product while at the same time minimizing exposure of the swabs to contaminants.

Hartman U.S. Pat. No. 5,147,035 discloses a thermoformed blister of flexible plastic material for a closable blister card display package including a cover and an egress opening. A hinge is provided through which the cover rotatably attaches to the body.

Lehman U.S. Pat. No. 2,455,685 discloses a dispensing container including detachable sections for forming finger access openings. The package includes yieldable margins so that the contents are normally confined to the container yet may be forcibly removed.

Lemoine U.S. Pat. No. 4,989,730 discloses a cotton swab shipping container and dispenser. For converting from a shipping container to the dispensing function, a removable "T" shaped panel is provided. Also, swab stops 50 are provided.

Gunderson U.S. Pat. No. 4,664,291 discloses a dispenser for cotton swabs which includes a flexibly lipped discharge port which is open to a restricted portion of the items contained in the dispenser for individual extraction against a mild resistance.

Capucio U.S. Pat. No. 3,261,501 discloses a dispenser for rod-shaped articles such as cotton-tipped swabs. The package is designed so that dispensing may be effected without contacting the ends of the articles. When it is desired to dispense the product, passage through a normally closed opening is carried out by using the thumb to engage the article's center portion through a cut-out 9 and to roll the article out of the package.

Pick U.S. Pat. No. 1,329,012 is directed to a match box having lower wall edges which yieldingly hold the lowermost match in the box. A slit is provided through which the matches can be withdrawn and the walls are cut away to expose the central portion of the lowest matches so that they can be gripped.

Monroe U.S. Pat. No. 1,157,951 discloses a matchbox having yieldable flaps permitting withdrawal of the matches and a central notch facilitating gripping of the matches.

Hamer U.S. Pat. No. 2,101,579 discloses a powder puff dispenser having perforations defining a pinch out section. The pinch out section bulges intermediate its ends.

NL 7713036 relates to a dispenser for cotton wool coated sticks. The dispenser includes a block-shaped holder with a rear wall of cardboard. The other walls are of thin, transparent plastic. A dispensing aperture is provided so that end parts of the sticks located in the holder are protected from being touched.

Despite the many attempts in the prior art to provide dispensers for cotton swabs or the like, there is still a need for an attractive package which provides easy dispensing yet which keeps the swabs clean prior to use.

SUMMARY OF THE INVENTION

The present invention is directed to a package including a simple opening for cotton swabs and the like. The package is easily fabricated yet protects the swabs prior to use and readily dispenses them when the consumer so desires. The package comprises a front wall and a base, the front wall having lines of weakness defining at least in part an access opening. The front wall lines of weakness include a medial portion and lateral sections on either side. At their lateral aspects, the lines of weakness define a width for the access opening which will not normally permit the fibrous balls at the ends of the swabs to exit the package. However, the front wall and the base are sufficiently flexible to permit a user readily to remove a swab from the package through the access opening at least at one of the lateral sections.

The cylindrical stick portion of the swab may be removed from the package through the medial portion of the access opening.

The access opening advantageously includes an elongated finger access aperture formed by lines of weakness in the base and extending transversely to the lateral lines of weakness. The elongated aperture permits one or more of the user's finger to contact a swab to pull it through the access opening without touching the ends of the swab.

In accordance with a preferred embodiment, the package is a blister pack including a paperboard base and a bubble cover of thin, transparent thermoplastic adhered to the base. The package of this embodiment includes lines of weakness in the base and cover together defining a removable access closure which upon removal forms an access opening including a medial area and lateral areas in the cover and a medial area in the base. The access opening permits access to the contents of the package.

As with the first embodiment, preferably the lines of weakness at the lateral portions define a width of the access opening which will not normally permit the fibrous balls at the ends of the swabs to exit the package. However, the front wall and the base are sufficiently flexible to permit a user readily to remove a swab from the package through the access opening at least at one of the lateral portions. Also, preferably an elongated finger aperture formed by lines of weakness in the base and extending transversely to the lateral lines of weakness permits one or more of the user's fingers to contact a swab to pull it through the access opening without touching the ends of the swabs.

For a more complete understanding of the above and other features and advantages of the invention, reference should be made to the following detailed description of preferred embodiments and to the accompanying drawings.

DETAILED DESCRIPTION OF THE INVENTION

Figure 1:
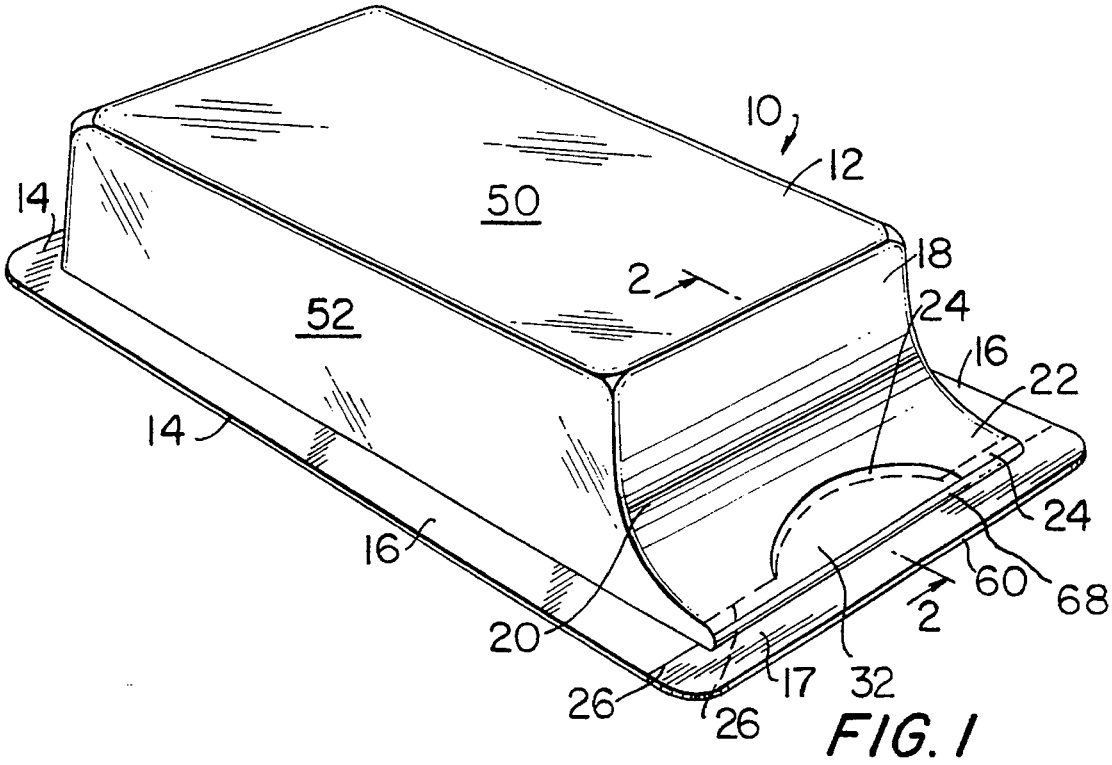
FIG. 1 is perspective view of the dispensing package according to the invention.
Figure 3:
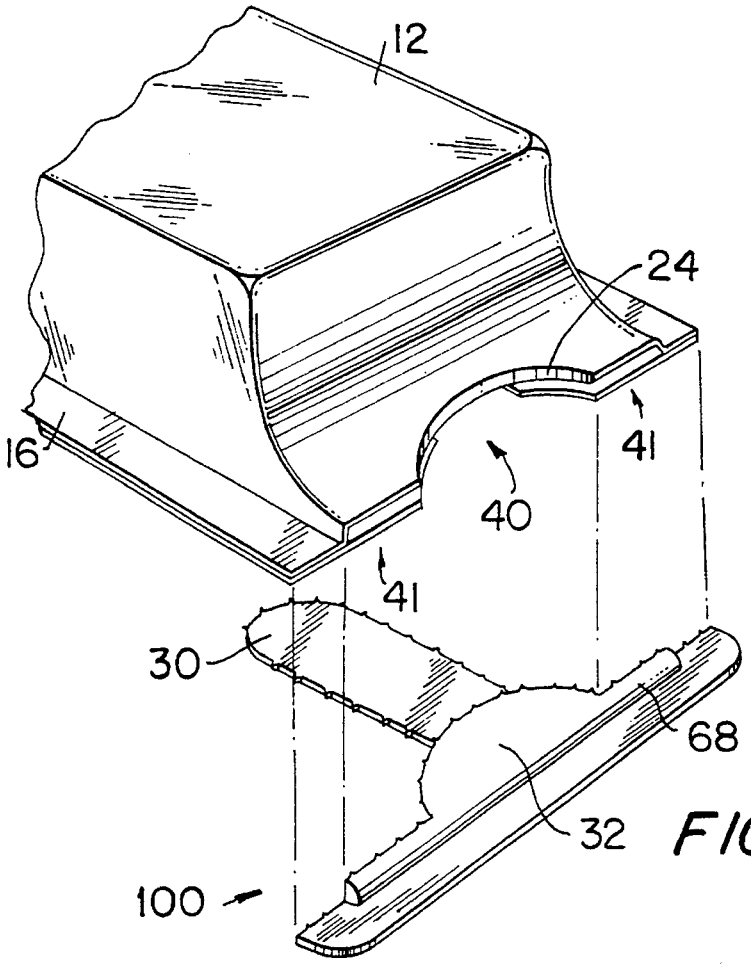
FIG. 3 is a fragmented perspective view of the dispensing package of the invention showing the access cutout removed.

Referring initially to FIG. 1, package 10 comprises cover 12 formed of a thin, transparent thermoplastic material and base 14 which is an essentially flat sheet of paperboard. The paperboard may be coated with a polymeric material if desired. At its margins 16, base 14 is adhered to the periphery of cover 12 by hot melt or other suitable adhesive to form a closed container. The package is particularly suited to containing cotton swabs having a cylindrical stick 38 and fibrous cotton balls 36 at each end, as are sold by the Chesebrough Ponds Company as Q-tips (R) Cotton Swabs.

Cover 12 includes top wall 50, left and right (not shown) side walls 52, a rear wall (not shown) and front wall 20.

Front wall 20 includes first descending portion 18, which extends from top wall 12 toward the base 14, and second descending portion 24. A medial portion of second descending wall 24 may optionally descend more abruptly at an angle of, say, close to 90° with the base. The medial aspect of second descending wall 24 is recessed in a semicircular shape from the rest of descending wall 24, which is generally parallel to the front edge 60 of the package.

At the bottom of the medial aspect of wall 24, wall 20 extends generally horizontally as section 32 toward the front of the package generally parallel to the base. Third descending portion 68 extends downwardly from section 32 toward the front of the package to front sealing margin 17. The lateral aspects of second descending wall 24 extend downwardly to sealing margin 17. Sealing margin 17 extends toward the front of the package, in contact with the margin of the base 14, from section 68 medially and from section 24 laterally.

In accordance with the invention, lines of weakness are provided in the cover and the base to facilitate opening of the package in the manner contemplated herein. The lines of weakness may comprise cuts in the plastic and paperboard, respectively, which cuts are spaced from each other so that portions of the material adjacent the cuts remain uncut, i.e., perforated lines. Thus, the material is weakened and may be readily separated along the lines by the user. Alternative lines of weakness such as partially cut score lines (cuts partially through the paperboard) may also be appropriate.

Figure 2:
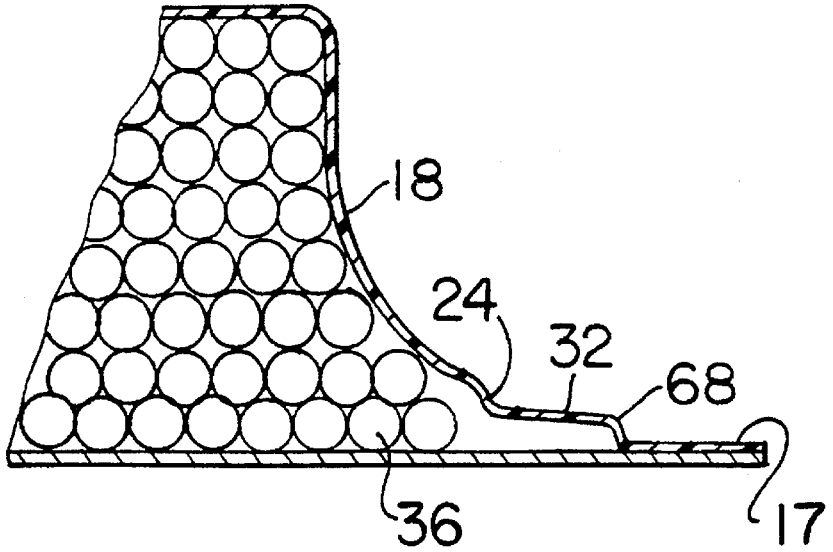
FIG. 2 is a cross section along the lines 2—2 of FIG. 1.
Figure 4:
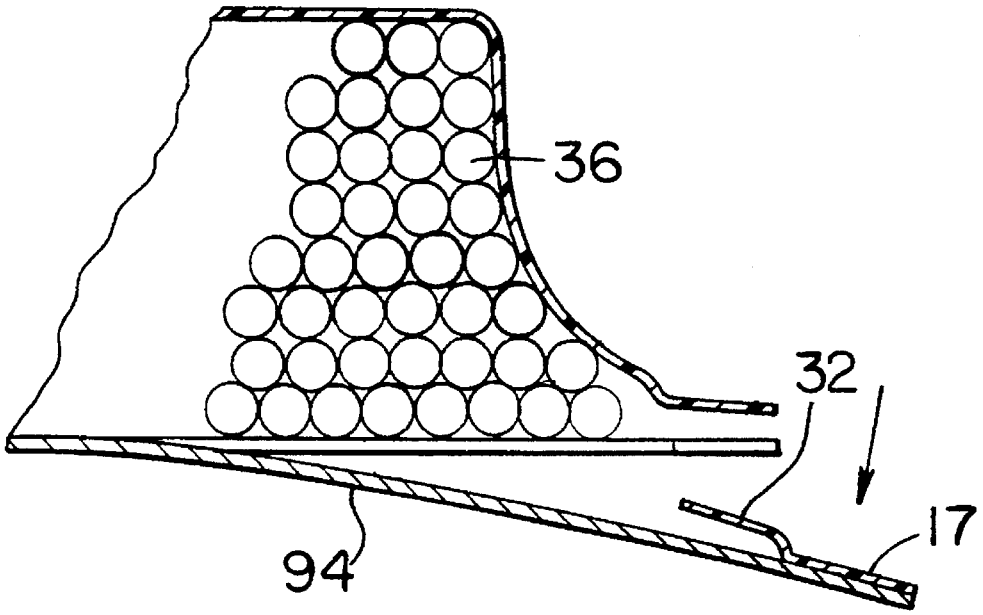
FIG. 4 is a cross section similar to FIG. 2, except that a portion of the lines of weakness, defining the access opening are broken.
Figure 5:
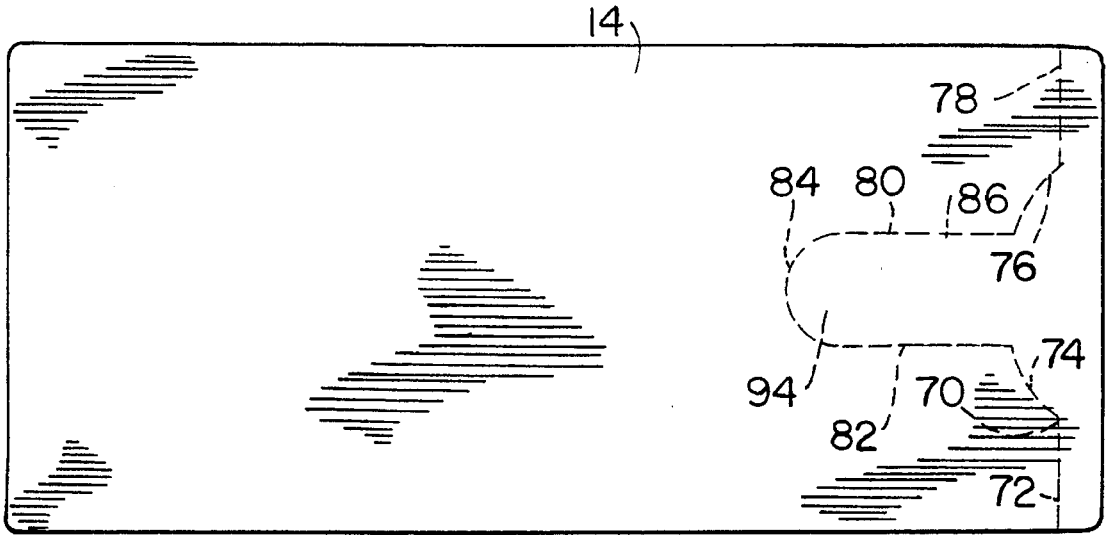
FIG. 5 is a bottom plan view of the dispensing package.
Figure 6:
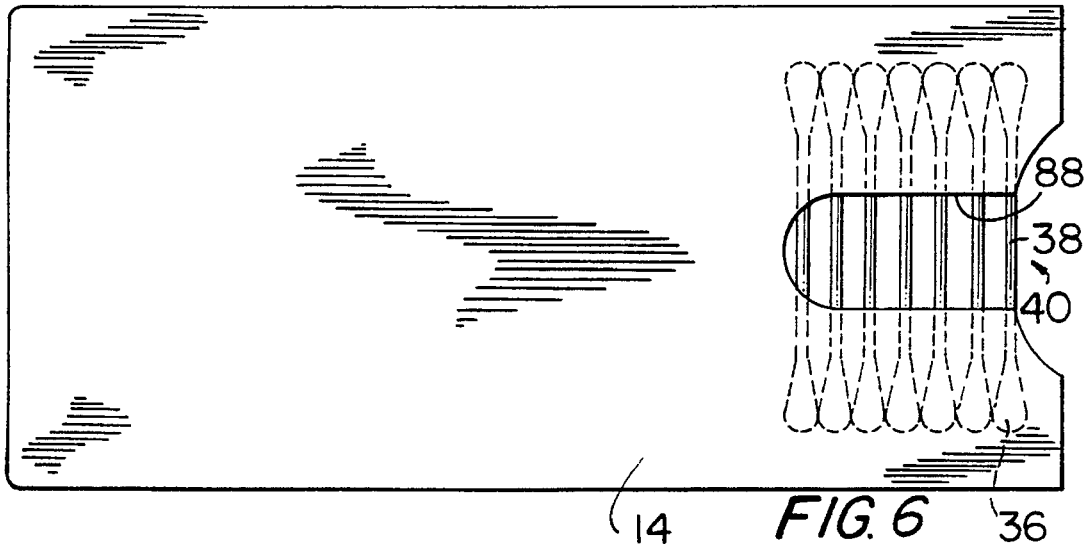
FIG. 6 is a bottom plan view of the dispensing package after the access aperture has been opened.
Figure 7:
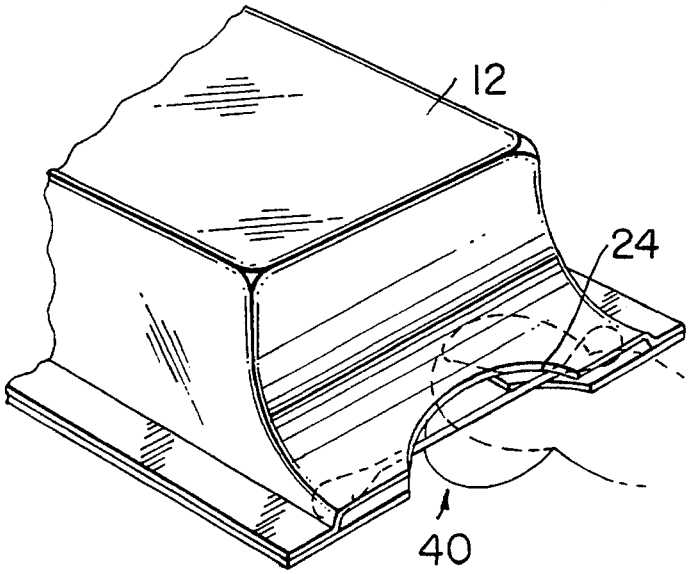
FIG. 7 is a fragmented perspective view of the dispensing package after it has been opened showing the process of removing a swab therefrom.

As seen in FIG. 1, line of weakness 26 in the cover begins at the left margin 16 and extends across the lateral lower aspects of front wall 20. For instance in the lateral aspects, line of weakness 26 may be imposed at or near the bottom of third descending wall 68. Or it may be disposed along a higher line on the wall as illustrated in FIG. 1. After extending through the left lateral section of wall 20, line of weakness 26 follows the semicircular path of medial aspect of wall 20 along the bottom of second descending wall 24 where it meets section 32. In FIG. 2, an interrupted vertical line shows where the line of weakness would intersect lower wall 20 if it were extended in a straight line from its positions in the lateral sections. After the medial aspect, line of weakness 26 continues in a straight line parallel to the front edge through the right lateral section of wall 20. The path of the line of weakness in the right lateral section may be as shown or may be at or near the base of third descending wall 68. After traversing the right lateral section, the line of weakness travels in a straight line through the right margin.

Line of weakness 70 in base 14 underlies and is in alignment with cover line of weakness 26 in the lateral margin and lateral coverall wall areas. Left lateral line of weakness 72, left medial arc of weakness 74, right medial arc of weakness 76 and right line of weakness 78 underlie and are in alignment with the cover margin and cover lateral lines of weakness and a portion of the cover medial lines of weakness in cover 12 described above. Thus, as will be discussed below, in these areas the lines of weakness may be separated by basically the same force applied to the package. Between arcs 74 and 76, section 80 of base line of weakness 70 includes a rectilinear portion 82 extending from arc 74 parallel to the longitudinal axis of the base, a semicircular portion 84 extending from section 82 and second rectilinear portion 86 parallel to section 82 and extending to the medial end of arc 76. When bottom cut out flap 94 formed by the base lines of weakness is removed, line of weakness 80 defines an elongated finger aperture 88 which facilitates access of the user to the center of the cylindrical stick portion 38 of the swab. Using aperture 88 to access the stick 38, the user avoids touching fibrous ball 36 which helps to preserve its cleanliness or sterility.

The package 10 may be sold as shown in FIG. 1. Alternatively, if desired, base 14 may be extended at the front and a circular or other hole cut centrally within the base and spaced from front edge 60. Preferably the cover does not overlie the portion of the base in which the hole is placed. The package would then be hung from the hole in a display rack.

When presented to consumers, the swabs can be seen through transparent cover 12 thereby attracting them to the product. The package is used as follows. Access to the swabs is obtained by tearing along cover line of weakness 26 and base line of weakness 70. Except for the portion of the base defined by line of weakness 80, lines 26 and 70 can be torn simultaneously and with force exerted at practically the same locations. Preferably, the lateral aspects of the lines are torn first, after which the arcs 74 and 76 and portions of line 26 aligned therewith are torn. Finally line of weakness 80 and the central portion of line 26 above aperture 88 are torn.

Upon tearing of the lines of weakness as above, closure 100, which combines aspects of the cover and the base, is removed resulting in central opening 40, lateral openings 41 and bottom finger aperture 88. The width of opening 41 is smaller than the diameter of fibrous balls 36 at the ends of the swabs. Thus, absent application of force to remove a swab, the swabs will remain secure within the package. Also, the restricted size of the openings 41 at the lateral aspects of the package adjacent the ends of the swabs tends to decrease the likelihood of contamination of the swabs.

Since the lateral sections of the access opening will not be wide enough to permit the fibrous balls of the swab to exit, it is not critical that the width of the medial section through which the cylindrical stick portion of the swab will be withdrawn is smaller than the diameter of the stick portion. However, the medial opening may have a smaller width if desired. The medial opening should be smaller in width than the diameter of the fibrous balls to avoid the possibility that the swab will exit from the medial section of the opening.

When it is desired to remove a swab, one finger can be positioned beneath the package at opening 88 to pull a swab forward and it can be grasped along the center with two fingers as it is pulled into opening 40. Therefore, contamination of the swab prior to use can be avoided. The flexibility of the thermoplastic from which the cover is made and of the paperboard base permit the swab to be pulled through openings 40 and 41 even though the fibrous balls at the ends of the swab are larger than openings 41.

As lower swabs are used, gravity will cause the upper swabs to fall downwardly toward aperture 88, where they can be pulled forward by one or more fingers. Also, as more swabs are used, remaining swabs may be moved forward toward aperture 88 by shaking the package.

The package of the invention permits dispensing of the swabs one-at-a-time rather than in groups and is quite easy for the consumer to use.

It should be understood, of course, that the specific forms of the invention herein illustrated and described are intended to be representative only, as certain changes may be made therein without departing from the clear teaching of the disclosure. Accordingly, reference should be made to the following appended claims in determining the full scope.

What is claimed is:

1. A package in combination with swabs comprising:

a) a paperboard base and b) a thermoplastic cover adhered thereto, c) said base comprising base lines of weakness, d) said cover comprising cover lines of weakness, e) said base lines of weakness and said cover lines of weakness together defining a removable access closure the removal of which forms an access opening in said package, said opening including a medial area and lateral areas in said cover and a medial area of said base, which access opening permits access to the contents of said package wherein said medial access opening defined in said base includes an elongated finger aperture extending in a direction transverse to said lateral portions of said access opening, said package containing said swabs comprising a stick having two ends and a ball of fibrous material at least at one of said ends, wherein said access opening is sufficiently narrow normally to confine said swabs to said package but wherein said package is sufficiently flexible to permit a user readily to remove a swab from the package through a portion of the access opening.

2. The package according to claim 1 wherein said base is essentially flat.

3. The package according to claim 2, which is a blister pack.

4. The package according to claim 1 wherein said cover is made of thin, transparent thermoplastic.

5. The package according to claim 2 wherein said cover includes a flat sealing surface along its periphery sealed to said flat base.

6. A package in combination with swabs comprising:

a) a paperboard base and b) a thermoplastic cover adhered thereto, c) said base comprising base lines of weakness, d) said cover comprising cover lines of weakness, e) said base lines of weakness and said cover lines of weakness together defining a removable access closure the removal of which forms an access opening in said package, said opening including a medial area and lateral areas in said cover and a medial area of said base, which access opening permits access to the contents of said package wherein said medial access opening defined in said base includes an elongated finger aperture extending in a direction transverse to said lateral portions of said access opening, said cover including a front wall which includes a first downwardly extending section extending toward said base, a forwardly extending section extending generally parallel to said base and a second downwardly extending section, said lines of weakness being disposed between said first downwardly extending section and said forwardly extending section, said package swabs comprising a stick having two ends and a ball of fibrous material at least at one of said ends wherein said cover lines of weakness include two ends and comprise a medial portion and at each end, a lateral portion, said cover lateral portions being spaced from said base to define a width of said access opening at said lateral portions which will not normally permit the fibrous balls to exit the package, said cover and base being sufficiently flexible to permit a user readily to remove a swab from the package through said access opening at least at one of said cover lateral portions.

7. The package of claim 6 wherein said medial portion is semicircular and extends concavely toward said front wall.

8. The package of claim 6 wherein the lateral portions of said cover lines of weakness and of said base lines of weakness are in alignment.

9. The package according to claim 6 wherein said cover front wall includes a further downwardly extending section above said first downwardly extending section.

* * * * *